US005211004A

United States Patent [19]

Black

[11] Patent Number: 5,211,004

[45] Date of Patent: May 18, 1993

[54] APPARATUS FOR REDUCING FUEL/AIR CONCENTRATION OSCILLATIONS IN GAS TURBINE COMBUSTORS

[75] Inventor: Stephen H. Black, Duanesburg, N.Y.

[73] Assignee: General Electric Company, Schenectady, N.Y.

[21] Appl. No.: 888,847

[22] Filed: May 27, 1992

[51] Int. Cl.[5] ..... F02C 7/22

[52] U.S. Cl. ..... 60/39.27; 60/737; 60/741

[58] Field of Search ..... 60/39.23, 39.27, 39.29, 60/734, 737, 740, 741

[56] References Cited

U.S. PATENT DOCUMENTS

| | | | |
|---|---|---|---|
| 2,613,500 | 10/1952 | Lysholm | 60/39.27 |
| 3,303,348 | 2/1967 | Cox et al. . | |
| 3,584,459 | 6/1971 | Amann | 60/39.27 |
| 3,921,390 | 11/1975 | Stoltman | 60/39.23 |
| 3,958,413 | 5/1976 | Cornelius et al. | 60/737 |
| 4,178,754 | 12/1979 | Earnest | 60/39.27 |
| 4,483,138 | 11/1984 | Willis | 60/737 |
| 4,506,503 | 3/1985 | Ogborne et al. | 60/39.281 |
| 4,529,887 | 7/1985 | Johnson | 60/39.27 |
| 4,634,887 | 1/1987 | Balch et al. . | |
| 4,835,962 | 6/1989 | Rutter | 60/737 |
| 5,129,222 | 7/1992 | Lampe et al. | 60/39.27 |

*Primary Examiner*—Richard A. Bertsch

*Assistant Examiner*—Timothy S. Thorpe

*Attorney, Agent, or Firm*—Nixon & Vanderhye

[57] ABSTRACT

A lean burn gas turbine combustor has a premixer zone receiving compressor discharge air through openings in a combustor liner. A fuel nozzle has an upstream orifice 52, a downstream orifice 56, and a captured response volume 54 therebetween. Upstream orifice 52 affords a high pressure drop for gaseous fuel to approximately the pressure of the compressor discharge air. The low pressure discharge orifice affords a pressure drop comparable to the pressure drop across the openings of the combustor liner for the air supply. The dynamic pressure response characteristics of the fuel and air inlets to the premixer zone are substantially matched to eliminate variations in fuel/air concentration resulting from pressure variations in the premixer zone. The captured response volume between the upstream and downstream orifices is sized sufficiently to store enough fuel to accommodate the mismatch in phase angle of fuel flowing into the captured response volume through the upstream orifice at a first phase angle relative to the phase angle of a pressure forcing function in the premixer zone and fuel flowing out of the captured response volume through the downstream fuel discharge orifice at a second phase angle relative to the phase angle of the pressure forcing function.

3 Claims, 3 Drawing Sheets

APPARATUS FOR REDUCING FUEL/AIR CONCENTRATION OSCILLATIONS IN GAS TURBINE COMBUSTORS

TECHNICAL FIELD

The present invention relates to apparatus and methods for minimizing or eliminating dynamic pressure amplification levels resulting from premixer fuel/air concentration oscillations in gas turbine combustors using the lean premixed combustion process and particularly relates to apparatus and methods for matching the dynamic response characteristics in fuel and air supply systems to gas turbine combustors to maintain essentially a constant fuel/air ratio substantially unaffected by fluctuations in gas temperature and pressure in the premixer of a lean burn gas turbine combustor.

BACKGROUND

The allowable emission levels for oxides of nitrogen ($NO_x$) and carbon monoxide (CO) from gas turbine exhausts has been and is being steadily reduced in light of environmental concerns. One method of obtaining very low exhaust emission levels, while maintaining high efficiency is to use combustion systems based on the lean premixed concept. In systems of this type, fuel and air are thoroughly mixed before combustion. While the mixing can be performed in several ways, the resulting concentration of the fuel/air mixture is sufficiently lean so that, upon combustion, the flame temperature is low enough to minimize the generation of $NO_x$. This fuel/air concentration is approximately one-half of the stoichiometric concentration and is only slightly above the concentration at which the reactions are no longer self-supporting (the weak limit) and the flame extinguishes.

Because these combustion systems are operated very near the reaction weak limit, there can be significant problems with combustion stability not normally encountered with traditional gas turbine combustion systems using diffusion flames operating at the stoichiometric fuel/air concentration. These instabilities can be produced by an oscillatory pressure field in the combustor which is often amplified through various physical mechanisms associated with the overall combustion system design. If the dynamic pressures exceed acceptable levels, the operation of the gas turbine and/or the mechanical longevity of the combustion system can be severely impacted.

While there are certain physical mechanisms associated with high dynamic pressure levels in premixed combustion which are the same as those for diffusion flame combustion systems, high dynamic pressures resulting from premixer fuel/air concentration oscillations are unique to lean premixed combustion systems In a typical lean premixed combustion system, there is provided a premixing zone, a flame holder and reaction zone, first-stage gas turbine nozzles, and fuel and air delivery systems. In the lean premixed combustion process, the fuel and air are delivered separately from supply sources with different dynamic characteristics relative to the premixing zone. On entering the reaction zone, the premixed fuel/air mixture is ignited by the hot gases maintained in the sheltered zone of the flame holder. After combustion, the resulting hot gases flow through the first-stage turbine nozzles, which accelerate the flow for flow through the first-stage turbine blades. The pressure required to displace the hot gases of combustion through the first-stage turbine nozzles is a function of the mass flow rate and temperature of the flow. The temperature of the gas flow depends, in turn, on the fuel/air concentration ratio entering the reaction zone. When the concentration is above that required to sustain reactions, the variation of combustion temperature with concentration is approximately linear. As the concentration approaches and passes through the weak limit, however, the variation of gas temperature with concentration becomes much larger, until ultimately the flame blows out.

A weak limit oscillation can occur in any lean premix system. The cycle of oscillation is as follows: (1) A pressure pulse, resulting from either basic combustion noise or a system upset of some sort, propagates through the system and into the premixer. Because the amount of fuel and air supplied to the premixer depends on the pressure in the premixer, this change in pressure, i.e., the pressure pulse, produces changes in both the fuel and air mass flow rates. Because the dynamic responses of the fuel and air supply systems are different, there is a change in the premixer fuel/air concentration. (2) The fuel and air at this new fuel/air concentration pass into the reaction zone where the fuel is burned to produce a new and different hot gas temperature. (3) The combustion product gases at the new temperature pass into the first-stage turbine nozzle. Because the nozzle back pressure depends on the gas temperature, a change in back pressure occurs. (4) This new pressure propagates into the premixer and the cycle repeats itself. Thus, when the mean fuel/air concentration in the premixer is near the weak limit, small changes in fuel/air concentration can lead to large fluctuations in gas temperature and pressure. Consequently, operation at these conditions, as required for good emissions, is particularly unstable. To my knowledge, there has been no clear methodology for minimizing the dynamic pressure levels resulting from these weak limit oscillations.

DISCLOSURE OF INVENTION

In accordance with the present invention, the dynamic pressure levels in lean premixed combustion systems are reduced by eliminating the amplification that results from the weak limit oscillation cycle. Generally, the weak limit oscillation cycle described above is broken by matching the dynamic response characteristics of the fuel and air supply systems to the premixer. Once the fuel and air supply systems respond substantially identically to pressure disturbances, then the premixer concentration will not substantially vary, with the result that the reaction zone gas temperatures stabilize and the combustion chamber pressure becomes relatively constant.

To accomplish the foregoing, the fuel delivery system is designed to have a dynamic pressure response characteristic substantially comparable to the pressure response characteristic of the air supply system. Typically, in a gas turbine combustion system, air is supplied to the premixer zone from the compressor discharge through holes in the combustor liner with a very small loss in total pressure. This is done because total pressure losses in the air supply have a very large impact on overall thermodynamic cycle efficiency. Because the air supply is lightly damped, it responds quickly and with very little phase angle difference in relation to any pressure forcing function (a pressure disturbance) extant in the premixer zone. In contrast, the fuel supply nozzle, e.g., natural gas, is typically designed to provide a high pressure loss concentrated at the location where the fuel is introduced into the premixer zone. Thus, the high pressure loss limits the influence that combustion chamber dynamic pressure oscillations have on total fuel flow and avoids any resonance which would otherwise lead to large fuel flow variations. However, the fuel system responds very slowly to the pressure forcing function (the pressure disturbance) and hence responds to pressure fluctuations with a relatively large phase angle. This mismatch in responsive amplitude and phase angle between the air and fuel supply systems produces variations in premixer fuel/air concentration which drives the weak limit oscillation cycle.

To minimize or eliminate this mismatch in the fuel and air supply systems, the fuel supply system has a fuel passage with an upstream orifice, a downstream discharge orifice, and a captured response volume between the two orifices. The upstream orifice has a very high pressure drop and thus performs the function of isolating the fuel system from the premix zone and providing uniform fuel distribution. The upstream orifice, moreover, is sized to provide a pressure drop such that the pressure downstream of the orifice and in the captured response volume approximates the pressure of the compressor discharge air. The downstream nozzle is, however, sized to have a very small pressure drop approximating the pressure drop of the compressor discharge air passing through the holes in the combustor liner into the premixer zone. Consequently, the pressure of the air and the fuel inlet to the premixer zone is approximately the same.

The captured response volume in the fuel passage between the upstream and fuel discharge orifices which is at approximately the same pressure as the compressor discharge pressure is thus coupled to the premixer zone with virtually the same damping characteristics as the air supply. Because the volume is fairly small, it has no resonant points at frequencies of importance to the combustion system and surging of fuel from the chamber does not occur. The volume is sufficiently large, however, to store enough fuel for at least one oscillatory cycle. It will be appreciated that fuel will flow into the captured response volume at one phase angle and be discharged therefrom into the premixer zone at another phase angle. Thus, the captured response volume must be sufficient in size to provide fuel to the premixer zone at any instant of time to make up the difference between the fuel flow into the captured response volume through the high pressure orifice and the fuel flow out of that volume through the low pressure orifice due to the phase angle mismatch of the flows through the orifices.

Accordingly, in a preferred embodiment of the present invention, there is provided a method of operating a gas turbine combustor in a lean premixed combustion mode, wherein the combustor has discrete fuel and air delivery systems, and a fuel/air premixer zone, comprising the step of substantially matching the dynamic pressure response characteristics of the fuel and air delivery systems of the combustor when delivering fuel and air to the premixer zone to substantially minimize or eliminate variations in fuel/air concentration provided the premixer zone resulting from pressure variations in the premixer zone.

In a further preferred embodiment according to the present invention, there is provided a method of operating a gas turbine combustor in a lean premixed mode, wherein the combustor has discrete fuel and air inlets and a fuel/air premixer zone for receiving the fuel and air, comprising the step of reducing dynamic pressure fluctuations in the combustor premixer zone resulting from premix fuel/air concentration ratio oscillations by substantially equalizing the pressure drop of air and fuel across the air and fuel inlets to the premixer zone.

In a still further preferred embodiment hereof, apparatus for stabilizing combustion in a gas turbine combustor operable in a lean premixed mode, and having a premixer zone is provided, comprising an air supply system including an opening for delivering air into the premixer zone of the combustor and having a predetermined pressure upstream of the opening, a nozzle including a fuel passage for passing fuel into the premixer zone of the combustor, the fuel passage having a discharge orifice for delivering fuel into the premixer zone. Means are provided upstream of the fuel discharge orifice for reducing the fuel pressure upstream of the fuel discharge orifice to approximately the predetermined pressure, the air supply opening and the fuel discharge orifice having substantially the same pressure drop, whereby pressure fluctuations in the premixer zone resulting from fuel/air concentration oscillations are substantially minimized or eliminated.

Accordingly, it is a primary object of the present invention to reduce the dynamic pressure levels in lean premixed combustion systems by minimizing or eliminating the amplification resulting from the weak limit oscillation cycle.

BEST MODE FOR CARRYING OUT THE INVENTION

Reference will now be made in detail to a present preferred embodiment of the invention, an example of which is illustrated in the accompanying drawings.

Figure 1:
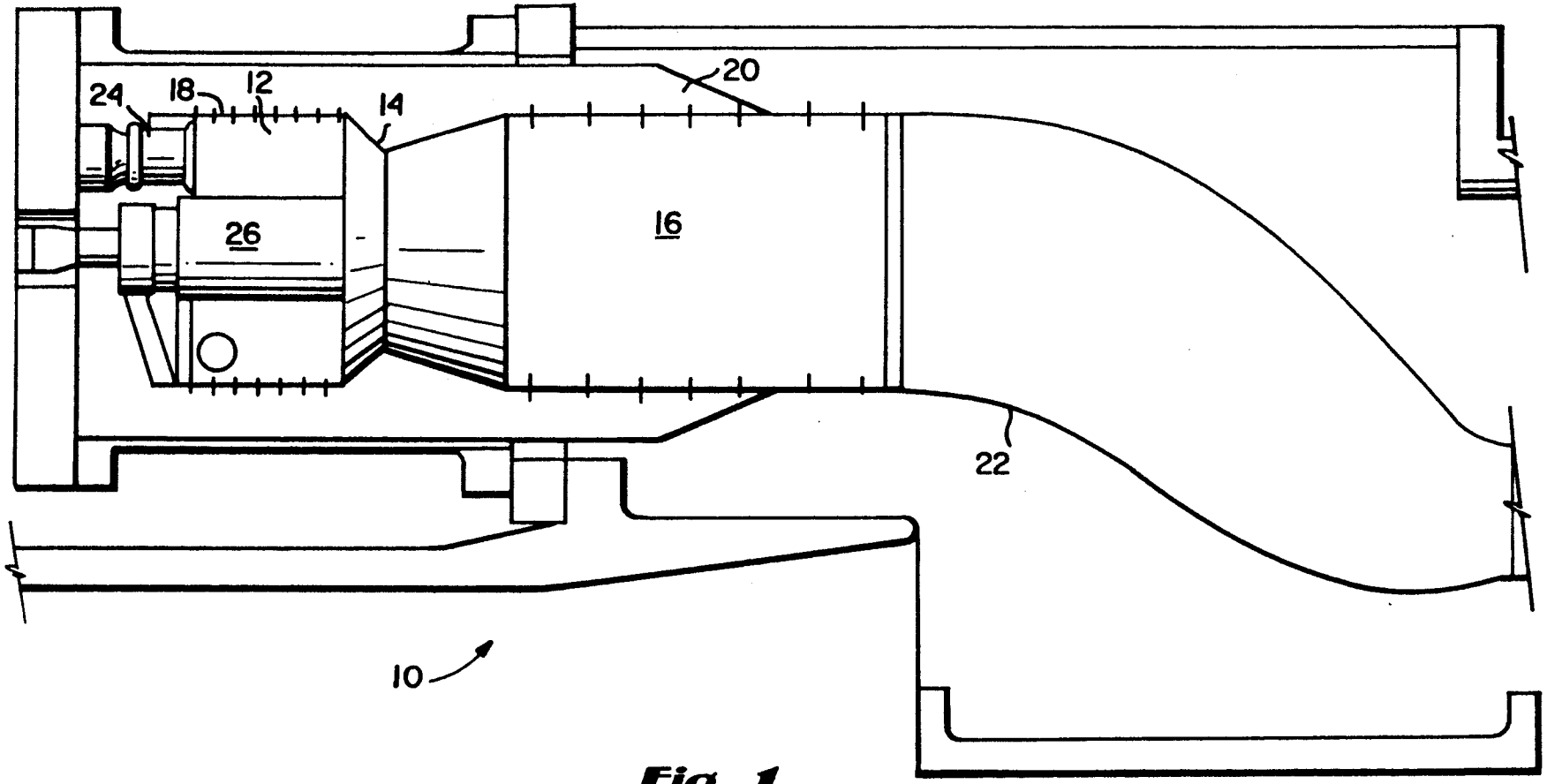
FIG. 1 is a schematic view of a lean premixed combustion system for a combustion turbine.

Referring now to FIG. 1, there is illustrated a combustion system for a gas turbine including a combustor, generally designated 10, including a premixer zone 12, a venturi assembly 14, a second-stage reaction zone 16, a liner assembly 18 for the premixer zone 12, and a liner assembly 20 for the second-stage reaction zone. Also illustrated is a transition piece 22 for delivering hot gases of combustion to the first-stage nozzles, not shown. A plurality of fuel nozzles 24, constructed in accordance with the present invention, are arranged in a circular array about a center body 26 for delivering fuel to the premixer zone 12 where the fuel is mixed with compressor discharge air passing through openings in the liner 18. Suffice to say there are a plurality of combustors in an annular array about the turbine housing, not shown.

Figure 3:
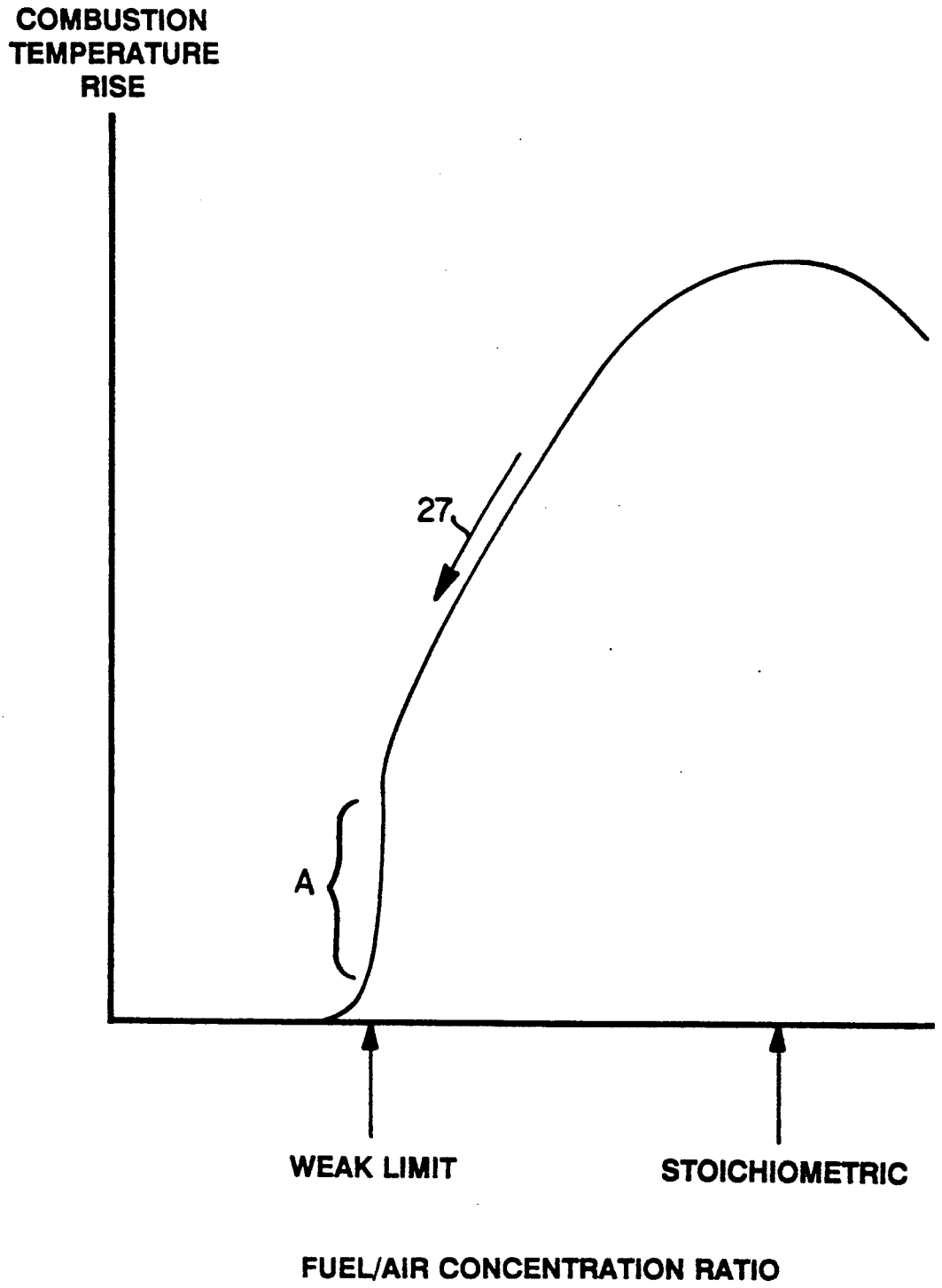
FIG. 3 is a graph illustrating the functional dependence of combustion temperature rise and fuel/air concentration ratio.

As indicated previously and with reference to FIG. 3, the conventional diffusion combustion process operates near or close to stoichiometric. As the fuel/air concentration becomes more lean as indicated by the arrow 27 in FIG. 3, combustion occurs at a decreasing temperature in a generally linear proportion. However, as the fuel/air concentration approaches the weak or flammability limit, the variation of gas temperature with the concentration becomes greatly pronounced. For example, the slope of the curve, indicated at A in FIG. 3, indicates that a further nominal decrease in the fuel/air concentration results in very significant decreases in combustion temperature. As indicated in this graph, ultimately the flame blows out. Consequently, for very small variations in fuel/air concentration, significant variations in combustion temperature occur when operating near the weak limit. Thus, when a pressure disturbance or pulse occurs in the system and changes the pressure in the premixer zone, the fuel and air mass flow rates change responsively but out of phase with one another. Hence, the premixer fuel/air concentration is changed at any given time and this, in turn, results in a fluctuation in the gas temperature in the reaction zone. That fluctuation in temperature changes the pressure in the premixer zone and, hence, effects a new concentration of fuel/air as the cycle continues, as a result of a mismatch in phase angle between the fuel and air delivery systems.

To prevent this pressure-induced fluctuation in fuel/air concentration, the dynamic pressure response characteristics of both the fuel and air delivery systems are substantially matched. To accomplish this while maintaining isolation of the fuel system from the combustion chamber and providing uniform fuel distribution, the fuel supply system is provided with an upstream fuel orifice affording a high pressure drop to about the pressure of the compressor discharge air and a downstream orifice having a low pressure drop to about the pressure in the compressor discharge air flow through the liner openings into the premixer zone, the two orifices being separated by a volume sized sufficiently to store enough fuel to accommodate the phase mismatch of fuel flowing into the volume through the upstream orifice at a first phase angle relative to the phase angle of the pressure disturbance and flowing out of the volume through the second orifice at a second phase angle relative to the phase angle of the pressure disturbance.

Figure 2:
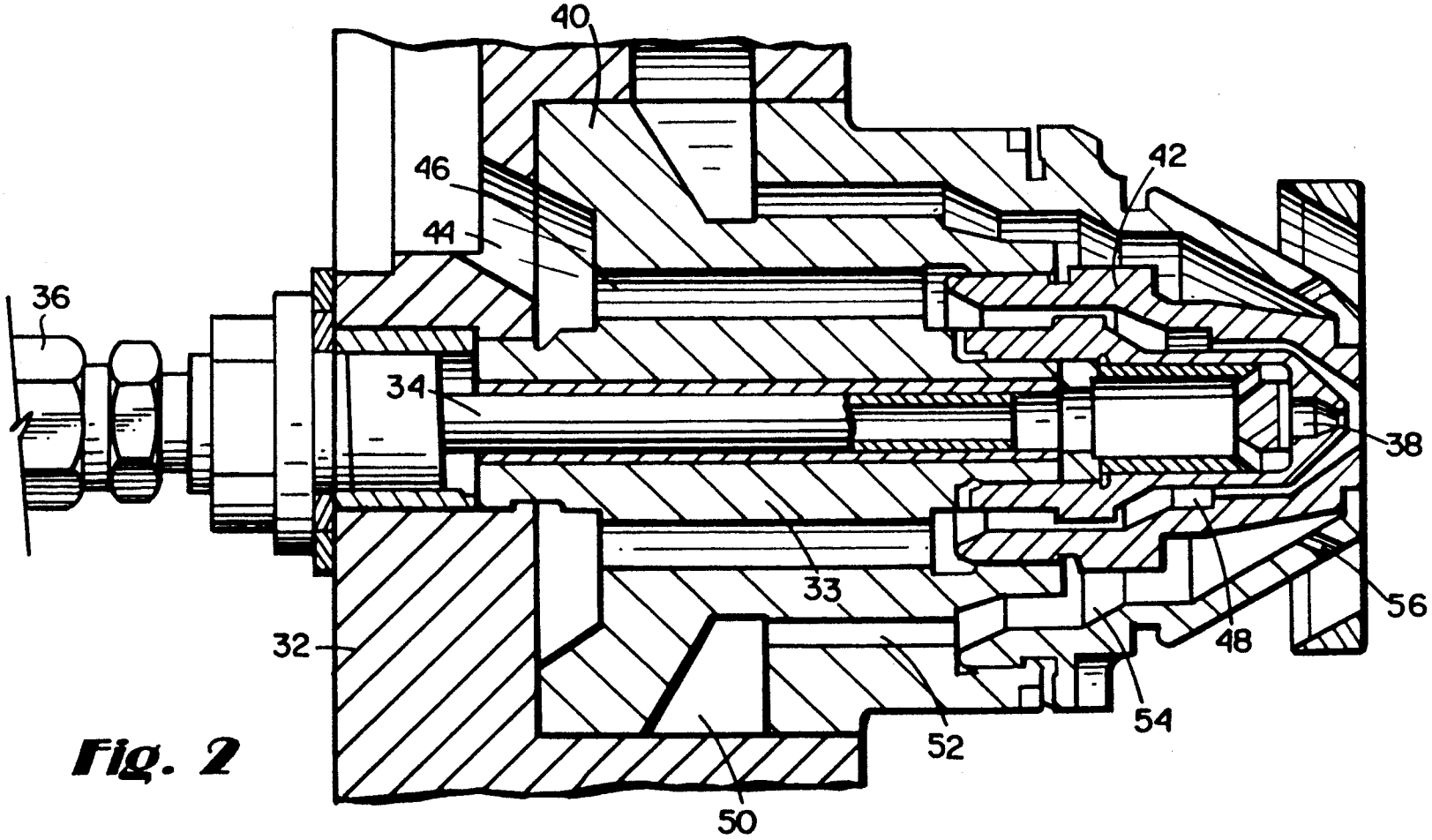
FIG. 2 is a fragmentary enlarged cross-sectional view of a two-stage fuel nozzle according to the present invention.

More particularly and with reference to FIG. 2, there is illustrated a two-stage fuel nozzle configuration according to the present invention comprised of a housing 32 having a sleeve 33 secured thereto defining a central bore for receiving a conduit 34. Conduit 34 is coupled to an oil supply, not shown, via a fitting 36 for delivering oil to a nozzle 38 at the opposite end of the bore. A fitting 40 is suitably secured to housing 32 and carries an end fitting 42 which forms part of the oil atomizing nozzle 38. Air under pressure is supplied an annulus 44 at one end of fitting 40 for flow through a plurality of circumferentially spaced bores 46 and through the annular space 48 between end fitting 42 and the oil/fuel nozzle 38 on the end of sleeve 33. At the end of the nozzle, the fuel oil is atomized for delivery into the premixer zone. The fuel nozzle of the foregoing description is conventional and further description is not believed necessary.

Fuel gas, for example, natural gas, is supplied an annulus 50 formed in the fitting 40 from a fuel gas source, not shown. The fitting 40 includes a plurality of circumferentially spaced axially extending bores 52 collectively constituting a first or upstream fuel orifice 52 having a high pressure drop. The bores 52 open into an annular chamber 54 formed with end fitting 42 and a plurality of circumferentially spaced fuel discharge nozzles are arranged about the end of fitting 40 for discharging fuel gas into the premixer zone. The nozzles 56 collectively constitute a downstream orifice 56 having a very low pressure drop. Additionally, the volume between the upstream and downstream orifices 52 and 56, respectively, constitutes a captured response volume 54 as described herein. As appreciated from the foregoing, fuel gas enters annular chamber 50 and passes through the upstream bores 52 constituting the upstream orifice, into the captured response volume 54, and through bores 56 into the premixer zone. The high pressure drop normally taken at the gaseous fuel exit nozzle in conventional fuel nozzles is thus spaced upstream from the premixer zone by the downstream low pressure orifice 56 and the captured response volume 54.

Assuming a pressure disturbance in the premixer zone resulting in a lower premixer zone pressure, the air supply to the premixer zone through the openings in the liner 18 will increase, the response being quick and having a small phase angle in relation to the phase angle of the pressure disturbance. If a conventional high pressure gas fuel nozzle was located at the premixer fuel discharge orifice, fuel flow would likewise tend to increase in response to the lowering of the premixer pressure. However, the response of the fuel supply to such decrease in pressure in the premixer zone would be longer than the response time of the air pressure across the liner openings, thus causing a mismatch in the phase angles between the fuel and air pressure responses. In accordance with the present invention, the high pressure drop in the fuel passage is taken at the first orifice 52 such that the pressure in volume 54 is substantially at the compressor discharge pressure. If the pressure drop through the openings in the liner supplying air to the premixer zone is substantially the same as the low pressure drop across the downstream gas fuel discharge orifice 56, then the phase angles, responsive to the pressure forcing function, will be substantially matched. By matching the phase angles, the fuel/air concentration remains substantially a constant, notwithstanding the pressure forcing function or pressure disturbance and its effect on the fuel and air delivery systems. Thus, in the previously described example where the pressure disturbing function lowers the pressure in the premixer zone, the fuel and air flow responses are matched maintaining the concentration substantially constant. Conversely, if the pressure disturbance elevates the pressure in the premixer zone, the fuel/air concentration will similarly remain constant. Thus, the weak limit oscillation cycle is substantially minimized or eliminated.

It will be appreciated that the captured response volume must have a volume sufficient to accommodate the mismatch in phase of fuel flowing into the volume through the first orifice at a first phase angle relative to the phase angle of the pressure forcing function and flowing out of the volume through the second orifice at a second phase angle relative to the phase angle of the pressure forcing function. That is, when fuel is discharged through the downstream low pressure nozzle into the premixer zone at a small phase angle relative to the pressure forcing function, there is a mismatch between that phase angle and the phase angle of the fuel supplied to the volume through the upstream high pressure first nozzle relative to the phase angle of the pressure forcing function. Consequently, there is a need to store fuel in the captured response volume sufficient to complete one cycle of operation. That is, in any one instant of time, fuel may be flowing into the volume at a faster rate than it flows out or fuel may flow out of the volume faster than it flows in. This difference in fuel resulting from the different phase angles must be stored in the volume and, accordingly, the volume must be sized sufficiently to accomplish that objective.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. Apparatus for stabilizing combustion in a gas turbine combustor operable in a lean premixed mode, and having a premixer zone, comprising:

an air supply system including an opening for delivering air into the premixer zone of the combustor and having a predetermined pressure upstream of said opening;

a nozzle including a fuel passage for passing fuel into the premixer zone of the combustor;

said fuel passage having a discharge orifice for delivering fuel into the premixer zone; and means upstream of said fuel discharge orifice for reducing the fuel pressure upstream of said fuel discharge orifice to approximately said predetermined pressure, said air supply opening and said fuel discharge orifice having substantially the same pressure drop, whereby pressure fluctuations in the premixer zone resulting from fuel/air concentration oscillations are substantially minimized or eliminated.

2. Apparatus according to claim 1 including a volume in said fuel passage upstream of said fuel discharge orifice.

3. Apparatus according to claim 1 wherein said reducing means includes an orifice in said fuel passage upstream of said fuel discharge orifice, said upstream orifice affording a higher pressure drop than the pressure drop across said fuel discharge orifice and a volume in said fuel passage between said upstream and fuel discharge orifices at substantially the same pressure as said predetermined pressure and sized sufficiently to store enough fuel to accommodate any mismatch in phase angle of fuel flowing into said volume through said upstream orifice at a first phase angle relative to the phase angle of any pressure fluctuation in the premixer zone and fuel flowing out of said volume through said discharge orifice at a second phase angle relative to the phase angle of the pressure fluctuation.

* * * * *